US007963750B2

(12) United States Patent
Yasoshima

(10) Patent No.: US 7,963,750 B2
(45) Date of Patent: Jun. 21, 2011

(54) HYDRAULIC PUMP

(76) Inventor: Tuyoshi Yasoshima, Oyabe (JP)

( * ) Notice: Subject to any disclaimer, the term of this patent is extended or adjusted under 35 U.S.C. 154(b) by 34 days.

(21) Appl. No.: 12/407,961

(22) Filed: Mar. 20, 2009

(65) Prior Publication Data

US 2009/0180906 A1 Jul. 16, 2009

Related U.S. Application Data

(63) Continuation of application No. PCT/JP2007/067445, filed on Sep. 6, 2007.

(30) Foreign Application Priority Data

Sep. 20, 2006 (JP) ..... 2006-253610
Nov. 21, 2006 (JP) ..... 2006-314912

(51) Int. Cl.
*F04B 35/02* (2006.01)

(52) U.S. Cl. ..... 417/328; 417/337

(58) Field of Classification Search ..... 417/328, 417/337, 329

See application file for complete search history.

(56) References Cited

U.S. PATENT DOCUMENTS

| | | | | |
|---|---|---|---|---|
| 459,280 | A * | 9/1891 | Garrett | 417/329 |
| 4,286,928 | A * | 9/1981 | Clay | 417/329 |
| 5,988,991 | A * | 11/1999 | Tsai | 417/328 |
| 7,261,523 | B2 * | 8/2007 | Da Silva | 417/329 |
| 2006/0017292 | A1 | 1/2006 | Matsubara | |
| 2006/0216163 | A1 * | 9/2006 | Park | 417/329 |

FOREIGN PATENT DOCUMENTS

| | | |
|---|---|---|
| JP | 54-114807 | 9/1979 |
| JP | 57-76278 | 5/1982 |
| JP | 3-53114 | 5/1991 |
| JP | 6-336970 | 12/1994 |
| JP | 9-137481 | 5/1997 |
| JP | 2000-54946 | 2/2000 |
| JP | 2006-29277 | 2/2006 |

OTHER PUBLICATIONS

English abstract of JP 6-336970 dated Dec. 6, 1994.
English abstract of JP 2006-29277 dated Feb. 2, 2006.
Patent Abstracts of Japan of JP 09-137481 dated May 27, 1997.

* cited by examiner

*Primary Examiner* — Charles G Freay
(74) *Attorney, Agent, or Firm* — Ladas & Parry LLP

(57) ABSTRACT

A hydraulic pump comprises a moving pressing member to compress a lower reservoir to move downward, and to move upward according to the change of buoyancy by the supply and discharge of the water into an inner space of the moving pressing member. A pumping pipe transports water in the lower reservoir outside of the pump.

10 Claims, 9 Drawing Sheets

HYDRAULIC PUMP

CROSS REFERENCE TO RELATED APPLICATION

This application is a continuation of International Application No. PCT/JP2007/067445, filed on Sep. 6, 2007, the entire contents of which is hereby incorporated by reference.

BACKGROUND OF THE INVENTION

1. Field of the Invention

The present invention relates to a hydraulic pump in which pressure is generated by supplying water to pump water to high or remote places.

2. Description of the Related Art

Generally, feeding of water to, for instance, rice fields (new paddy fields), temporary housing, various construction sites, etc., in high or remote places requires the use of a pump or irrigation channel equipment. In addition, since power can be generated by introducing water from lower ground to high places and allowing it to fall to lower ground again to generate power, the number of sites able to generate hydraulic power increases more significantly than usual.

A known conventional pump that satisfies such requirements is, for example, a high pressure water pumping device in which a motor and an engine can be optionally switched. The suction port is provided below a float on the water source, and the discharge pipe is connected to the transport pipe line through a flexible coupling. The pipe line is laid in a U-shaped underground ditch through a tubular elastic material and connected to multiple discharge ports and multiple vent valves (see, e.g., Japanese Laid-open Patent [Kokai] Publication No. H09-137481A, hereinafter referred to as "patent document 1").

SUMMARY OF THE INVENTION

Nevertheless, the conventional technology as cited in patent document 1 necessitated the use of a motor or engine, which resulted in high production costs. It also required the consumption of high voltage power or fuel, resulting in high running costs. Accordingly, the conventional technology has not been economically advantageous.

The present invention is intended to solve the above-mentioned problems of the conventional technology and to provide an economically desirable hydraulic pump which can reduce manufacturing costs or running costs significantly.

The present invention in accordance with one embodiment provides a hydraulic pump comprising:

a pump outer wall body having a wall body;

a waterway through which water is fed into the pump outer wall body;

a moving pressing member which is longitudinally movably housed within the pump outer wall body to compress a lower reservoir to move downward as the water is fed, and to move upward due to buoyancy as the water is discharged after being fed in the aforementioned manner;

a pumping pipe which is connected to the bottom of the base side of the pump outer wall body to transport the water that is fed due to the downward movement of the moving pressing member; and a discharge pipe, which is connected to the bottom of the base side of the pump outer wall body to discharge the water after being fed in the aforementioned manner to the moving pressing member which is in the bottom of the pump moving pressing member, wherein the moving pressing member comprises:

an open/close valve, which controls whether to feed the water from the waterway to the internal space of the moving pressing member; and a water passage valve, which controls whether to feed the water from the waterway to the lower reservoir; and the water passage valve is allowed to open as the moving pressing member surfaces, and is allowed to close as the moving pressing member ceases to surface.

The hydraulic pump may comprise a side reservoir for the water passage occupying at least some space between the pump outer wall body and the moving pressing member.

The pump outer wall body may comprise a stopper to limit the range in which the moving pressing member can move longitudinally.

The pumping pipe may comprise a check valve.

The hydraulic pump may comprise a control means to control opening and closing of the water passage valve.

The present invention in accordance with another embodiment provides a hydraulic pump comprising:

a pump outer wall body having a wall body;

a waterway through which water is fed to the pump outer wall body;

a pumping water reservoir that is provided at a bottom of the base side of the pump outer wall body to store the water;

a water pumping member having buoyancy in advance which is longitudinally movably housed within the pumping water reservoir area;

a moving pressure applying member which has a pressing member which is longitudinally movably housed within the pump outer wall body to press the water pumping member in the pumping water reservoir area, and moves downward together with the pressing member as the water is fed, and moves upward with the pressing member due to buoyancy after the water is discharged in the aforementioned manner;

a pumping pipe, which is connected to the bottom of the base side of the pump outer wall body to transport the water in the pumping water reservoir being pushed out as the water pumping body moves downward due to the compression of the pressing member;

a discharge pipe, which is connected to the bottom of the base side of the pump outer wall body to discharge the water after the water is fed in the aforementioned manner to the moving pressure applying member which is provided at a bottom of the hydraulic pump; and a feeding pipe to feed water to the pumping water reservoir as the moving pressure applying member moves upward after the water is discharged; wherein the moving pressure applying member comprises:

a feeding open/close valve, which controls whether to feed the water to the internal space thereof via the waterway;

the feeding open/close valve closes as the moving pressure applying member moves downward or upward; and the moving pressure applying member is provided at a given upper position in the hydraulic pump and opens as the water is fed.

The hydraulic pump may comprise a guide member to guide the moving pressure applying member for the longitudinal movement, and a circulation space of the water which is provided between the pump outer wall body and the guide member to feed the water to the pumping water reservoir area.

The pumping pipe and the feeding pipe may comprise a check valve.

The hydraulic pump may comprises control means to control opening and closing of the feeding open/close valve and the discharge open/close valve whenever it is required.

BRIEF DESCRIPTION OF THE DRAWINGS

The features and advantages of the present invention will become more apparent from the detailed description set forth below when taken in conjunction with the drawings in which like reference numbers indicate identical or functionally similar elements.

DETAILED DESCRIPTION OF THE PREFERRED EMBODIMENTS

The present invention can provide an economically desirable hydraulic pump which can reduce manufacturing costs or running costs significantly.

Figure 1:
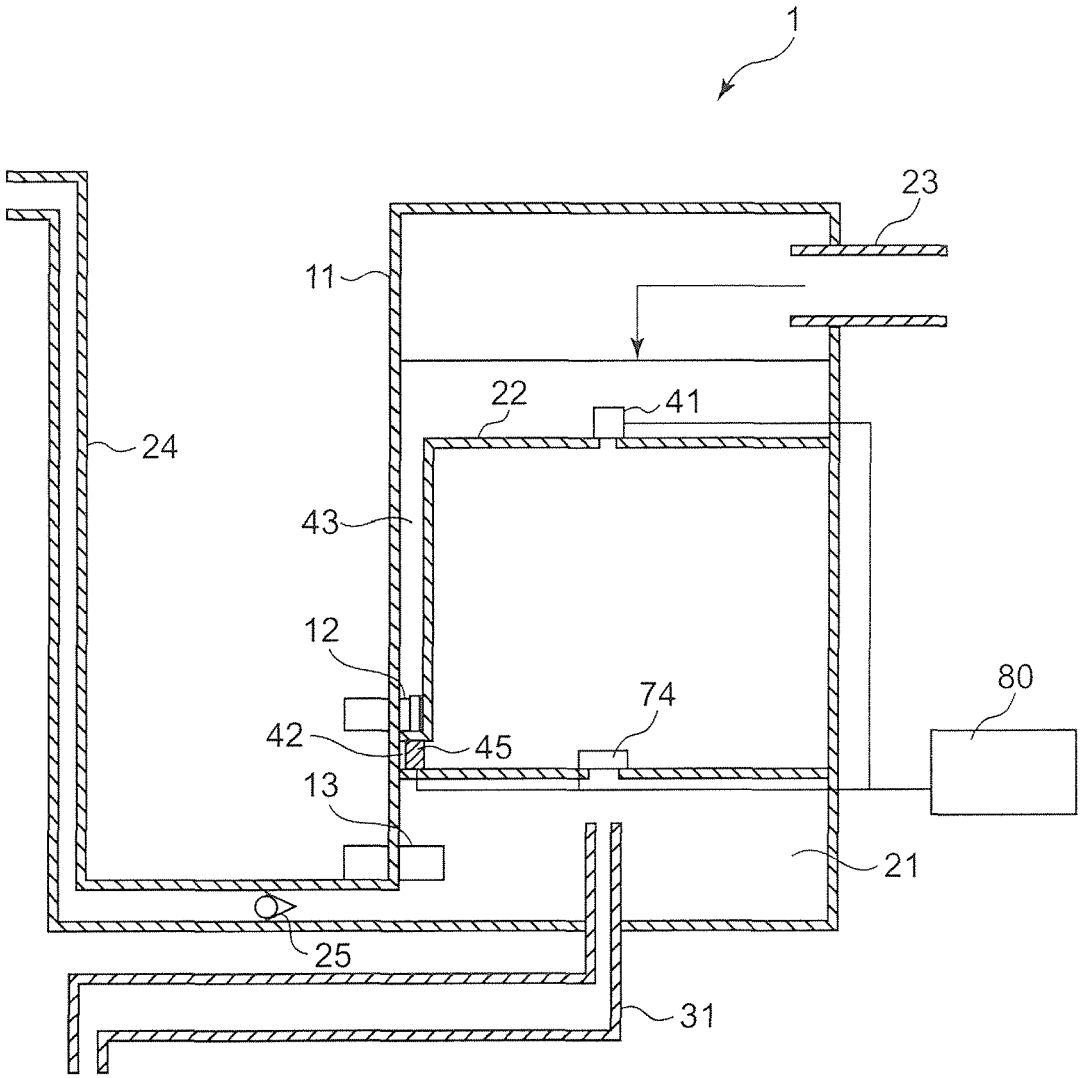
FIG. 1 is a schematic diagram illustrating the hydraulic pump of Embodiment 1 before it is operated.

Embodiment 1 of the hydraulic pump of the present invention is described herein with reference to the drawings. FIG. 1 is a schematic diagram illustrating the configuration of hydraulic pump 1 in this embodiment.

Hydraulic pump 1 comprises a pump outer wall body 11 having a wall body and moving pressing member 22 which is longitudinally movably housed within the pump outer wall body 11 so that its downward movement pressurizes lower reservoir 21 by the weight of water fed to pump 1 while its upward movement is caused by buoyancy gained from the discharge of water after being fed.

Pump outer wall body 11 is made of a given metal or another material. Pump outer wall body 11 has a square cylinder-like shape, for instance, and has a space in which moving pressing member 22 similarly having a square cylinder-like can move longitudinally sufficiently. It is desirable that pump outer wall body 11 have an air vent which is formed on the surface of the ceiling.

Inside pump outer wall body 11 are stoppers 12, 13 which limit longitudinal strokes for moving pressing body 22.

At a position which is part of pump outer wall body 11 and which is on the relatively higher side where the longitudinal stroke of moving pressing member 22 is not disturbed, inserted and fixed is waterway 23 which feeds water to the space in pump outer wall body 11.

Pumping pipe 24 which transports water fed from lower reservoir 21, which is allowed to have a high pressure by the downward movement of moving pressure member 22, is connected to part of pump outer wall body 11, which is the side face of a lower level of lower reservoir 21 in pump outer wall body 11 where longitudinal strokes of moving pressing member 22 are not disturbed.

Pumping pipe 24 comprises check valve 25 which is allowed to open with the compression by the downward movement of moving pressing member 22 and to close by the self-rebound during the upward movement of moving pressing member 22.

To another bottom of the base side of pump outer wall body 11, discharge pipe 31, which discharges water that has been fed to moving pressing member 22 during the downward movement, is connected.

Discharge pipe 31 comprises an open/close valve (not illustrated). When moving pressing member 22 moves downward to reach a certain point, the open/close valve is opened to allow water in moving pressing member 22 to be discharged through discharge pipe 31.

On the other hand, moving pressing member 22, which provides an internal storage space defined by the wall body, comprises open/close valve 41 on the ceiling of the wall body to control whether to supply water from the aforementioned waterway 23 to the internal space.

Open/close valve 41 may be opened or closed by driving a stepping motor, for example. Alternatively, it may be opened or closed by the use of non-contact or contact by pressing between the valve and the tip of waterway 23 pointing downward (not illustrated in detail).

The contact by pressing between the valve and the tip of waterway 23 pointing downward is the state in which the tip of waterway 23 presses open/close valve 41 relatively as moving pressing member 22 moves upward.

Moving pressing member 22 comprises protruding section 42 protruding aside on some area of the base side at the lower level. The longitudinal strokes are limited as protruding section 42 contacts stoppers 12, 13 in pump outer wall body 11.

Moreover, protruding section 42 comprises a water passage valve 45 which controls whether to pass water from the aforementioned waterway 23 to lower reservoir 21.

The water passage valve 45 is opened or closed by driving a stepping motor, for example. It is closed as moving pressing member 22 moves downward (and when the surfacing stops) while it is opened as moving pressing member 22 moves upward (as it surfaces).

Moving pressing member 22 has a base having a discharge open/close valve 74 through which discharge pipe 31 penetrates as moving pressing member 22 moves downward beyond a certain degree. Nevertheless, instead of the opening, the base may have a pipe that can penetrate discharge pipe 31, and discharge pipe 31 may have an open/close valve so that the valve is allowed to open as the pipe applies a pushing force to the open/close valve.

On the other hand, side reservoir 43, through which water is fed to lower reservoir 21, is provided to at least some space between the inner side surface of pump outer wall body 11 and the outer side surface of moving pressing member 22.

Note that hydraulic pump 1 of this embodiment comprises a control means 80 (control circuit) which controls the opening or closing of the aforementioned water passage valve 45 in protruding section 42 of moving pressing member 22 or the aforementioned open/close valve in a timely manner.

Water may be fed from waterway 23 all the time. As the space in moving pressing member 22 is filled with more than a certain amount of water (it can also be filled to the brim), the weight of moving pressing member 22 at that time, which is the maximum pressure, is applied to the water filled in lower reservoir 21 below moving pressing member 22.

The maximum pressure of lower reservoir 21 allows check valve 25 of pumping pipe 24 to open and is released to pumping pipe 24. As a result, being further compressed by the downward movement of moving pressing member 22, water in lower reservoir 21 is lifted to a high place through pumping pipe 24.

Moreover, also during the downward movement of moving pressing member 22, water from waterway 23 continues to accumulate on moving pressing member 22.

Figure 2:
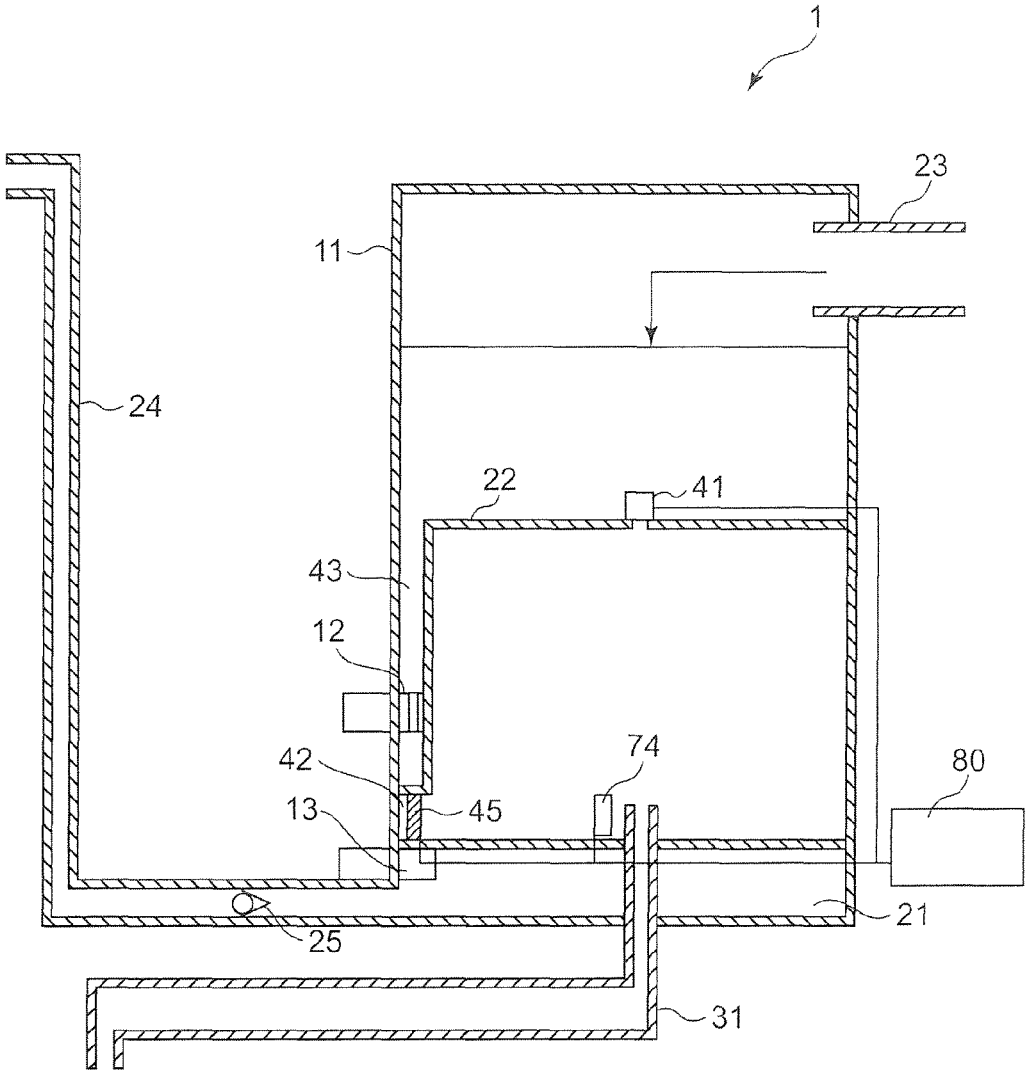
FIG. 2 is a schematic diagram illustrating the hydraulic pump of Embodiment 1 after it is operated.

On the other hand, as the open/close valve on discharge pipe 31 opens as moving pressing member 22 moves downward, water in moving pressing member 22 is discharged through discharge pipe 31, causing air to flow backward in moving pressing member 22 (See FIG. 2).

As the discharge is completed, the weight of moving pressing member 22 is reduced and water passage valve 45 at protruding section 42 opens, water on moving pressing member 22 is directed to lower reservoir 21 while letting moving pressing member 22 to begin moving upward.

At this time, check valve 25 of pumping pipe 24 closes to prevent the water remaining in pumping pipe 24 from flowing backwards.

By repeating the above cycle, water constantly fed from waterway 23 can be transported to high or remote places through pumping pipe 24.

Furthermore, the use of a bypass pipe having a check valve from an optional position in the upper space of pump outer wall body to lower reservoir 21 will eliminate the need for a motor for all of the above open/close valves. The need for electric control can hence be eliminated entirely.

Figure 3:
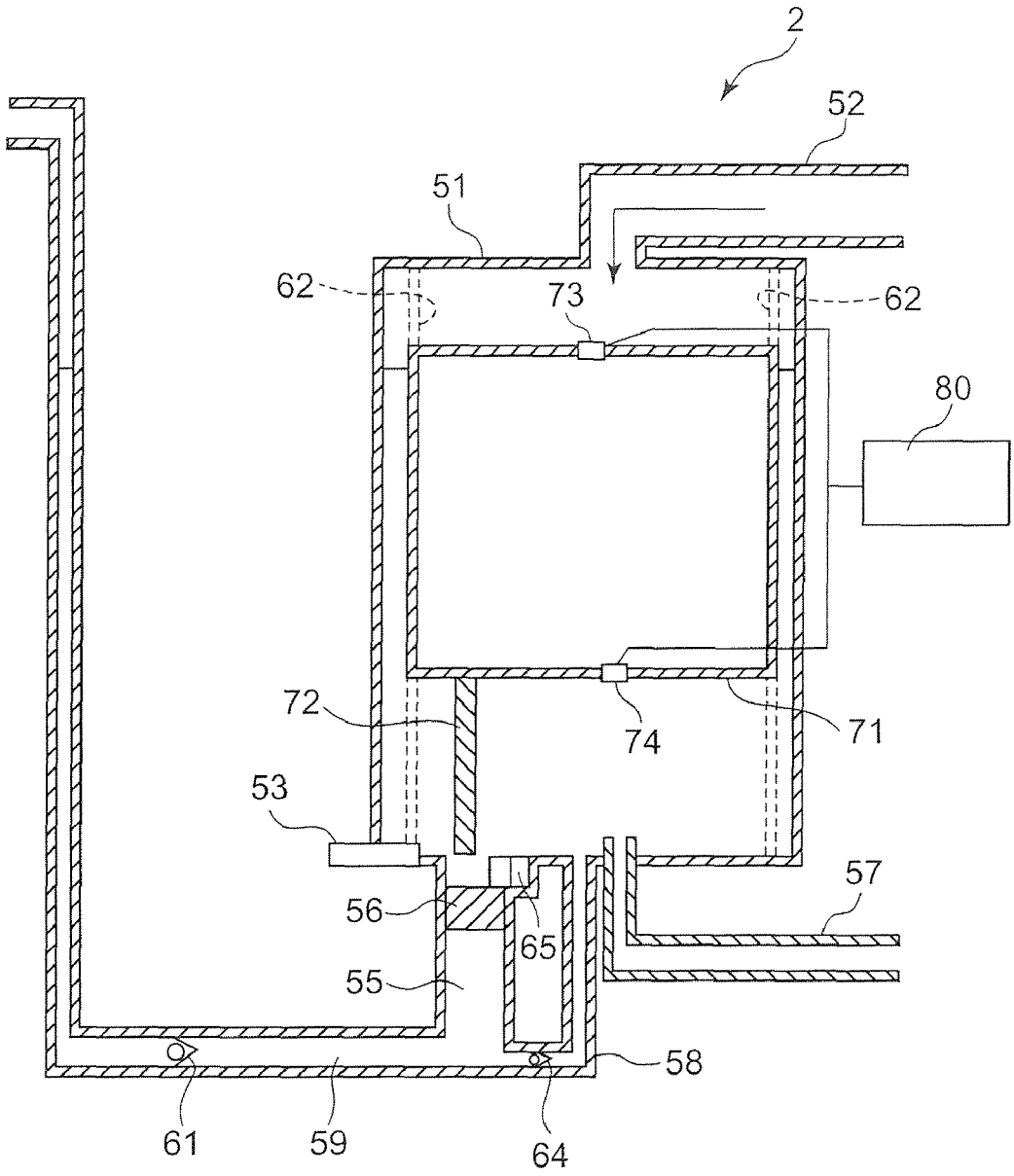
FIG. 3 is a schematic diagram illustrating the side view of the hydraulic pump of Embodiment 2.
Figure 4:
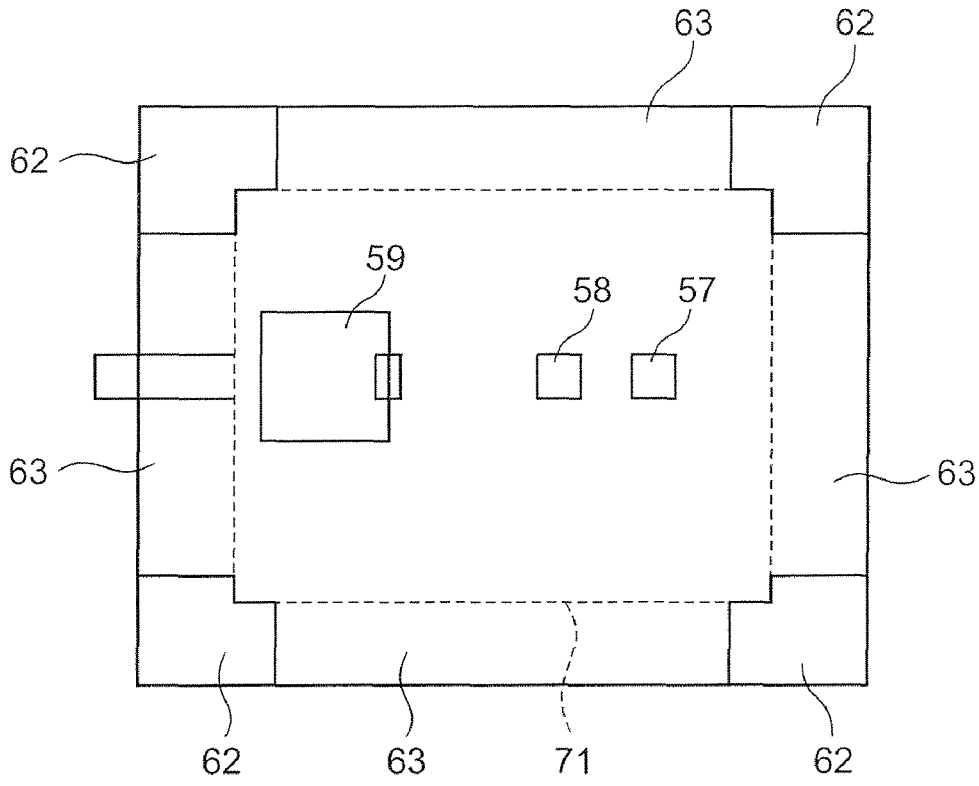
FIG. 4 is a schematic diagram illustrating the top view of the hydraulic pump of Embodiment 2.

Next, Embodiment 2 of the hydraulic pump of the present invention is described herein with reference to the drawings. FIG. 3 is a schematic diagram illustrating the side view of hydraulic pump 2 of this embodiment. FIG. 4 is a schematic diagram illustrating the top view of hydraulic pump 2 of this embodiment.

Hydraulic pump 2, as shown in FIG. 3, is described herein. It comprises a pump outer wall body 51 having a wall body, and moving pressure applying member 71 which is longitudinally movably housed within the pump outer wall body 51.

Pump outer wall body 51 is made of a given metal or another material and has a square cylinder-like shape, for instance. It also has a space (described in detail later) in which moving pressure applying member 71 having a square cylinder-like shape, for example, can move longitudinally sufficiently.

It is desirable that pump outer wall body 51 has an air vent formed on the surface of the ceiling, for example, in order to enhance the efficiency of the longitudinal movement of moving pressure applying member 71. However, waterway 52 described later may also be used as an air vent.

Inside pump outer wall body 51 formed is stopper 53 which limits the downward stroke for moving pressure applying member 71. However, stopper 53 may have intermittent steps.

At a position on the ceiling face side, for example, which is part of pump outer wall body 51, and on the relatively higher side where the longitudinal stroke of moving pressure applying member 71 is not disturbed, inserted and fixed is waterway 52 which feeds water to the space in pump outer wall body 51.

Since hydraulic pump 2 in use is constantly fed with a given amount of water from waterway 52, it continues operating all the time as described in detail later.

At a low position below part of the base of pump outer wall body 51, provided is water pump reservoir 55 having a cylindrical shape, for example, in which pumping water is stored. Water pump reservoir 55 is made of a given metal and has a cylindrical shape having a total length of 11 meters, for example. However, the total length of water pump reservoir 55 can be selected optionally.

Inside cylindrical water pump reservoir 55 housed is pressure plate 56 having buoyancy in advance so that it can move longitudinally within cylindrical water pump reservoir 55. Pressure plate 56 moves longitudinally as moving pressure applying member 71 described later moves longitudinally.

Nevertheless, the upward stroke of pressure plate 56 is limited by stopper 65 which is provided near the area between part of the base of pump outer wall body 51 and the part constituting or connecting water pump reservoir 55 of the base.

At the bottom of the base side of pump outer wall body 51 connected is discharge pipe 57 to discharge water after the feeding to the aforementioned moving pressure applying member 71 at a low position. It is desirable that discharge pipe 57 to have an open/close valve (not illustrated) as well in order to maintain highly reliable performance of the pump.

Discharge pipe 57 protrudes inside pump outer wall body 51 by the length over a certain degree from the base side of pump outer wall body 51 so that, as moving pressure applying member 71 described later moves downward more than a certain degree, the tip side of discharge pipe 57 penetrates moving pressure applying member 71 relatively.

Water discharged from discharge pipe 57 may be discharged into rivers, etc. as is.

Furthermore, feeding pipe 58 is connected to another bottom of the base side of cylindrical water pump reservoir 55 so that water is fed into water pump reservoir 55 as moving pressure applying member 71 moves upward after water is discharged. Feeding pipe 58 is connected to the area between part of the base of pump outer wall body 51 and the bottom of the base side of cylindrical water pump reservoir 55 so that water can flow through feeding pipe 58.

At the low position of cylindrical pumping water reservoir 55 connected is pumping pipe 59 to transport the aforementioned water in the aforementioned water pump reservoir 55 being pushed out as pressure plate 56 moves downward when it is pushed by later described pressing member 72 of moving pressure applying member 71.

Pumping pipe 59 comprises check valve 61 to prevent pumping water from flowing backward. Check valve 61 is configured so that it opens at the maximum pressure, which is the weight of the maximum amount of the water fed by moving pressure applying member 71.

In other words, the hydraulic pressure, which is the maximum pressure generated by the maximum amount of water fed by moving pressure applying member 71, allows check valve 61 to open, which allows moving pressure applying member 71 to move downward.

Hydraulic pump 2, as shown in FIG. 4, comprises guide members 62 at four corners within pump outer wall body 51 to guide moving pressure applying member 71 to stabilize its longitudinal movement.

Between pump outer wall body 51 and guide members 62 at four corners, provided is circulation space 63 to feed the water into the water pump reservoir 55.

Water that passes circulation space 63 is led to the water pump reservoir 55 through feeding pipe 58. Since feeding pipe 58 comprises check valve 64 (See FIG. 3), when the hydraulic pressure which feeds pumped water into water pump reservoir 55 is generated, check valve 64 prevents water in pumping water reservoir 55 from flowing back to feeding pipe 58.

Because water in water pump reservoir 55 is prevented from flowing back to feeding pipe 58, the hydraulic pressure grows fully in water pump reservoir 55 before water is pumped, and the pumped water passing through pumping pipe 59 can secure its performance fully.

On the other hand, as shown in FIG. 3, moving pressure applying member 71, which provides an internal storage space defined by the wall body comprises feeding open/close valve 73 on the ceiling of the wall body to control whether to feed water from the aforementioned waterway 52 to the internal space.

Feeding open/close valve 73 may be opened or closed by driving a stepping motor, for example. Alternatively, it may be opened or closed by the use of non contact or contact by pressing between the valve and the tip of waterway 52 pointing downward (not illustrated in detail).

The contact by pressing between the valve and the tip of waterway 52 pointing downward is the state in which the tip of waterway 52 presses feeding open/close valve 73 relatively as moving pressure applying member 71 moves upward.

In the latter case, after enough water is fed into moving pressure applying member 71 and moving pressure applying member 71 begins moving downward, feeding open/close valve 73 rebounds itself to close as it no longer contacts the tip of waterway 52 by pressing.

Moving pressure applying member 71 comprises pressing member 72 protruding downward at part of the lower base side to push pressure plate 56 in pumping water reservoir 55 as moving pressure applying member 71 moves downward.

In other words, since the downward movement of moving pressure applying member 71 allows pressing member 72 protruding downward to push pressure plate 56 downward, the hydraulic pressure in water pump reservoir 55 increases, thus pushing water in water pump reservoir 55 out to pumping pipe 59 and to the outside world.

Further, moving pressure applying member 71 limits the maximum stroke of the downward movement in such a way that at least part of its base touches stopper 53 in pump outer wall body 51.

At another position of the base of moving pressure applying member 71 provided is discharge open/close valve 74, which allows discharge pipe 57 to relatively penetrate as moving pressure applying member 71 moves downward beyond a certain degree.

Discharge open/close valve 74 may be opened or closed by driving a stepping motor, for example. Alternatively, it may be opened or closed by the use of non contact or contact by pressing between the valve and the tip of discharge pipe 57 pointing upward (not illustrated in detail).

Note that, in the latter case, the contact by pressing between the valve and the tip of discharge pipe 57 pointing upward is the state in which the tip of discharge pipe 57 relatively presses and opens discharge open/close valve 74 as moving pressure applying member 71 moves downward.

In the latter case, as water in moving pressure applying member 71 is discharged through discharge pipe 57 and, at the same time, moving pressure applying member 71 filled with air gains buoyancy, moving pressure applying member 71 begins moving upward.

After moving pressure applying member 71 begins moving upward, discharge pipe 57 rebounds itself to close as it loses the press-contact relationship with discharge pipe 57.

On the other hand, in order to employ the aforementioned stepping motor, etc. (not illustrated in detail) of the latter case to control feeding open/close valve 73 or discharge open/close valve 74, hydraulic pump 2 of this embodiment comprises the control means 80 (control circuit, etc.) which controls opening or closing of water feeding open/close valve 73 or discharge open/close valve 74 in a timely manner.

During the operation, water is constantly fed from waterway 52. Being filled in the space in moving pressure applying member 71 beyond a certain degree (it may also be filled to the brim) pressing member 72 of moving pressure applying member 71 having the weight of moving pressure applying member 71 at that moment pushes pressure plate 56. As a result, the maximum pressure is applied to water that is filled in water pump reservoir 55.

Since the maximum pressure of water pump reservoir 55 allows check valve 61 of pumping pipe 59 connected to water pump reservoir 55 to open, water in pump water reservoir 55 is released to pumping pipe 59.

When the pressure in water pump reservoir 55 is released to pumping pipe 59, moving pressure applying member 71 is allowed to move downward. As a result, moving pressure applying member 71 begins moving downward while feeding open/close valve 73 closes.

Figure 5:
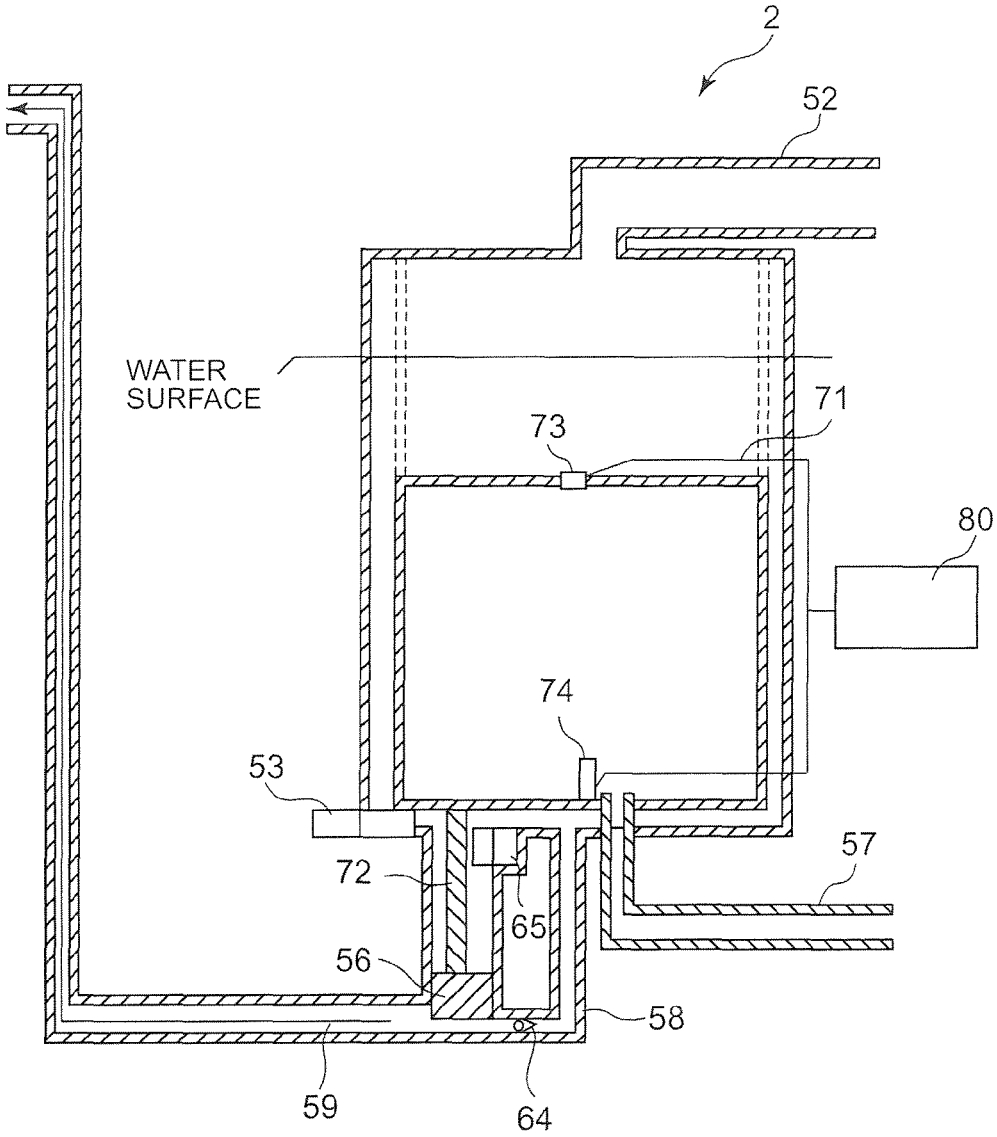
FIG. 5 is a schematic diagram illustrating the side view of the hydraulic pump of Embodiment 2 after one cycle of operation.

Accordingly, since moving pressure applying member 71 continues its downward movement while pressing member 72 pushes pressure plate 56 downward, water in water pump reservoir 55 is transported to a high place through pumping pipe 59 (See FIG. 5).

Additionally, during the downward movement of moving pressure applying member 71, water from waterway 52 continues to accumulate in pump outer wall body 51.

On the other hand, as discharge open/close valve 74 of discharge pipe 57 opens due to the downward movement of moving pressure applying member 71, water in moving pressure applying member 71 is discharged through discharge pipe 57 and, at the same time, air returns to moving pressure applying member 71 backward.

When the discharge of water is finished, being filled with air, moving pressure applying member 71 becomes lighter, and moving pressure applying member 71 begins to move upward; this reduces the pressure in pumping water reservoir 55 and allows check valve 61 of pumping pipe 59 to close.

Furthermore, as the upward movement of moving pressure applying member 71 progresses after the discharge is finished, discharge open/close valve 74 of moving pressure applying member 71 closes while moving pressure applying member 71 continues to move upward in a stable manner.

Moreover, since the upward movement of moving pressure applying member 71 allows check valve 64 of feeding pipe 58 to open, water continues to be filled into water pump reservoir 55 through feeding pipe 58 (See FIG. 3).

Since pressure plate 56 has buoyancy in advance, the buoyancy-induced negative pressure inside water pump reservoir 55 allows water to be filled into water pump reservoir 55 efficiently.

By repeating the above-mentioned cycle water fed from waterway 52 constantly can be transported to a high or remote place through pumping pipe 59 without using electric power or firepower.

Optionally, however, water pump reservoir 55 may be provided at the center of the base of pumping outer wall body 51 so that it is perpendicular to the lower plane and, at the same time, multiple discharge pipes 57 and multiple feeding pipes 58 may also be provided in the periphery of water pump reservoir 55, which is at the center of the base of pump outer wall body 51.

The tip side of each of multiple feeding pipes 58 may be connected to the lower position of water pump reservoir 55 directly. Alternatively, it may be connected to a water collection box provided to water pump reservoir 55.

In other words, how water pump reservoir 55, discharge pipe 57, and feeding pipe 58 are laid out with respect to the base or side surface of pump outer wall body 51 is optional.

Next, Embodiment 3 of the hydraulic pump the present invention is described. Hydraulic pump 3 of Embodiment 3 of the present invention is characterized by the fact that it comprises:

a pump outer wall body having a wall body;

a waterway through which water is fed into the pump outer wall body;

a pumping water reservoir that is provided at a bottom of the base side of the pump outer wall body to store the water;

a water pumping member having buoyancy in advance which is longitudinally movably housed in aid pumping water reservoir area;

a moving pressure applying member which has a pressing member which is longitudinally movably housed within the pump outer wall body to move downward while pressing the pumping member in the pumping water reservoir as the water in the pump outer wall body is discharged, and moves upward as the water is fed into the pump outer wall body;

a pumping pipe, which is connected to the bottom of the base side of the pump outer wall body to transport the water in the pumping water reservoir being pushed out as the water pumping body moves downward due to the compression of the pressing member;

a discharge pipe, which is connected to the bottom of the base side of the pump outer wall body to discharge the water to allow the moving pressure applying member to move downward; and a feeding pipe to feed water to the pumping water reservoir as the moving pressure applying member moves upward after the discharge of water; wherein the pumping pipe comprises a shuttle valve, and the discharge pipe comprises a discharge open/close valve, and the feeding pipe comprises feeding check valve; wherein the discharge open/close valve opens as the moving pressure applying member moves downward and closes as the moving pressure applying member moves upward; and the water feeding shuttle valve opens as water is fed into the pumping water reservoir area.

The above-mentioned hydraulic pump has the following constitutions;

The hydraulic pump is characterized by the fact that it further comprises a discharge door at the base side of the side face of the pump outer wall body to discharge the water in the pump outer wall body so as to allow the moving pressure applying member to move downward.

Figure 6:
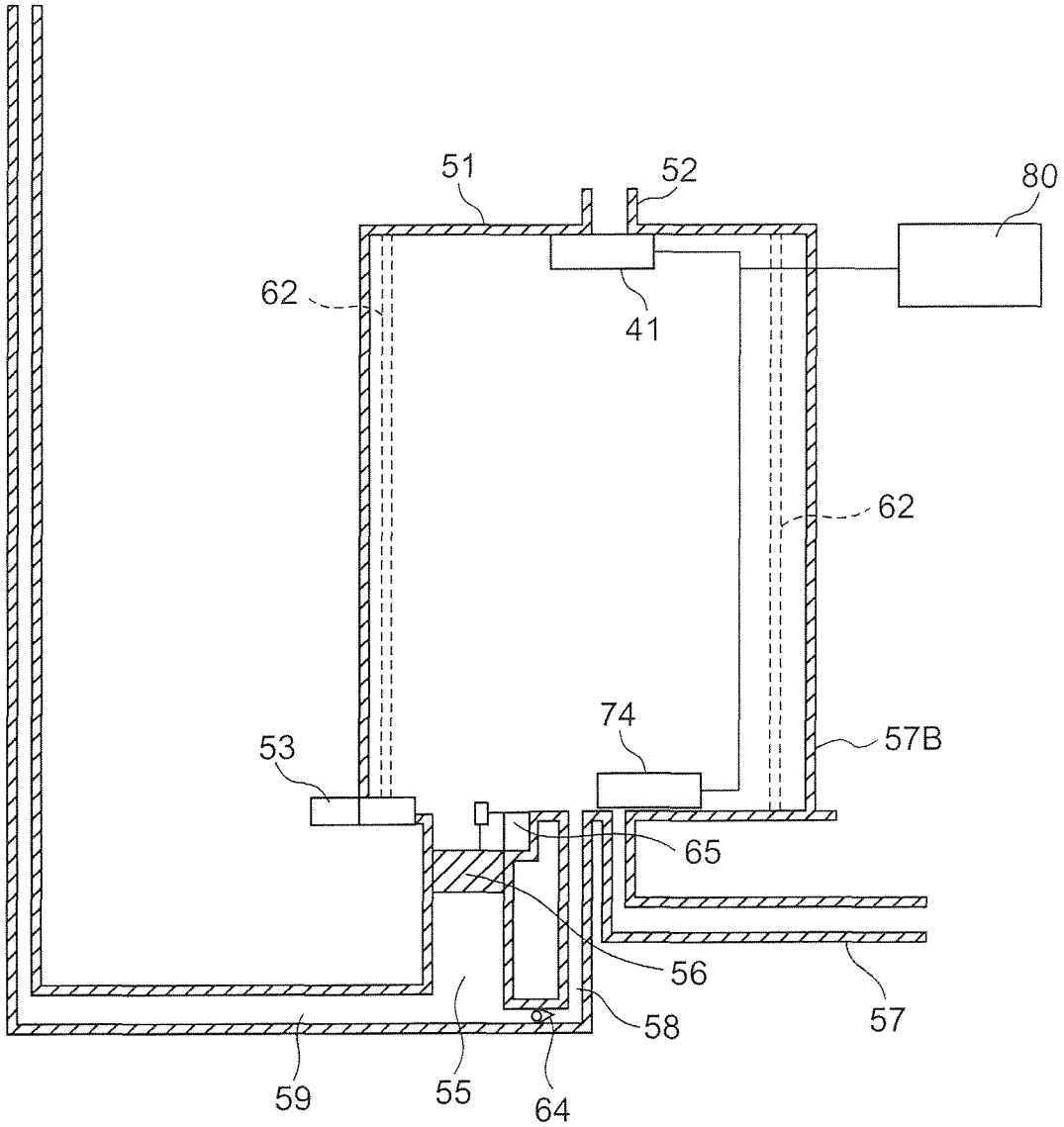
FIG. 6 is a schematic diagram illustrating the side view of the hydraulic pump of Embodiment 3.
Figure 7:
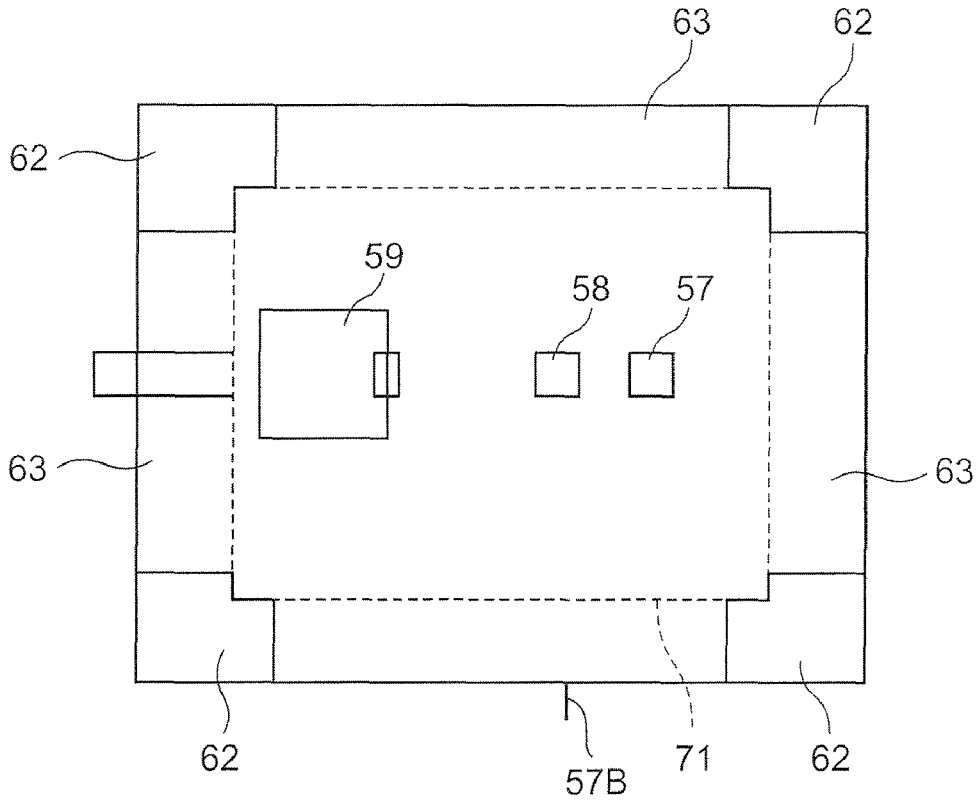
FIG. 7 is a schematic diagram illustrating the top view of the hydraulic pump of Embodiment 3.

Embodiment 3 of the hydraulic pump of the present invention is described herein with reference to the drawings. FIG. 6 is a schematic diagram illustrating the side view of hydraulic pump 3 of this embodiment. FIG. 7 is a schematic diagram illustrating the top view of hydraulic pump 3.

It is noted that the components that are the same as those of hydraulic pump 2 of Embodiment 2 have the same reference symbols and are not described in detail.

First, in this embodiment, moving pressure applying member 71 is in the completely sealed state in which no open/close valve is employed at all. However, moving pressure applying member 71 may have a weight having a given weight (see FIG. 8).

The inlet side openings of discharge pipe 57 and water feeding pipe 58 are fixed on the base of pump outer wall body 51 so that these pipes will not protrude from the base inside pump outer wall body 51. This is done to increase the downward stroke of moving pressure applying member 71 for the length that would have protruded otherwise.

On the other hand, discharge pipe 57 comprises a discharge open/close valve 74. This discharge open/close valve opens as moving pressure applying member 71 moves downward and closes as moving pressure applying member 71 moves upward.

Moreover, feeding pipe 58 comprises a feeding check valve 64. This feeding check valve opens to feed water to water pump reservoir 55 as moving pressure applying member 71 moves upward, when pumping member 56 surfaces.

Furthermore, waterway 52 also comprises a feeding open/close valve. This water feeding open/close valve opens as moving pressure applying member 71 moves upward and closes as moving pressure applying member 71 moves downward.

At the base side of the side face of pump outer wall body 51 provided is discharge door 57B. This discharge door 57B opens as moving pressure applying member 71 moves downward and closes as moving pressure applying member 71 moves upward.

It is noted that opening or closing of each of the discharge open/close valve, feeding open/close valve, and discharge door 57B is controlled by a control means 80.

Figure 8:
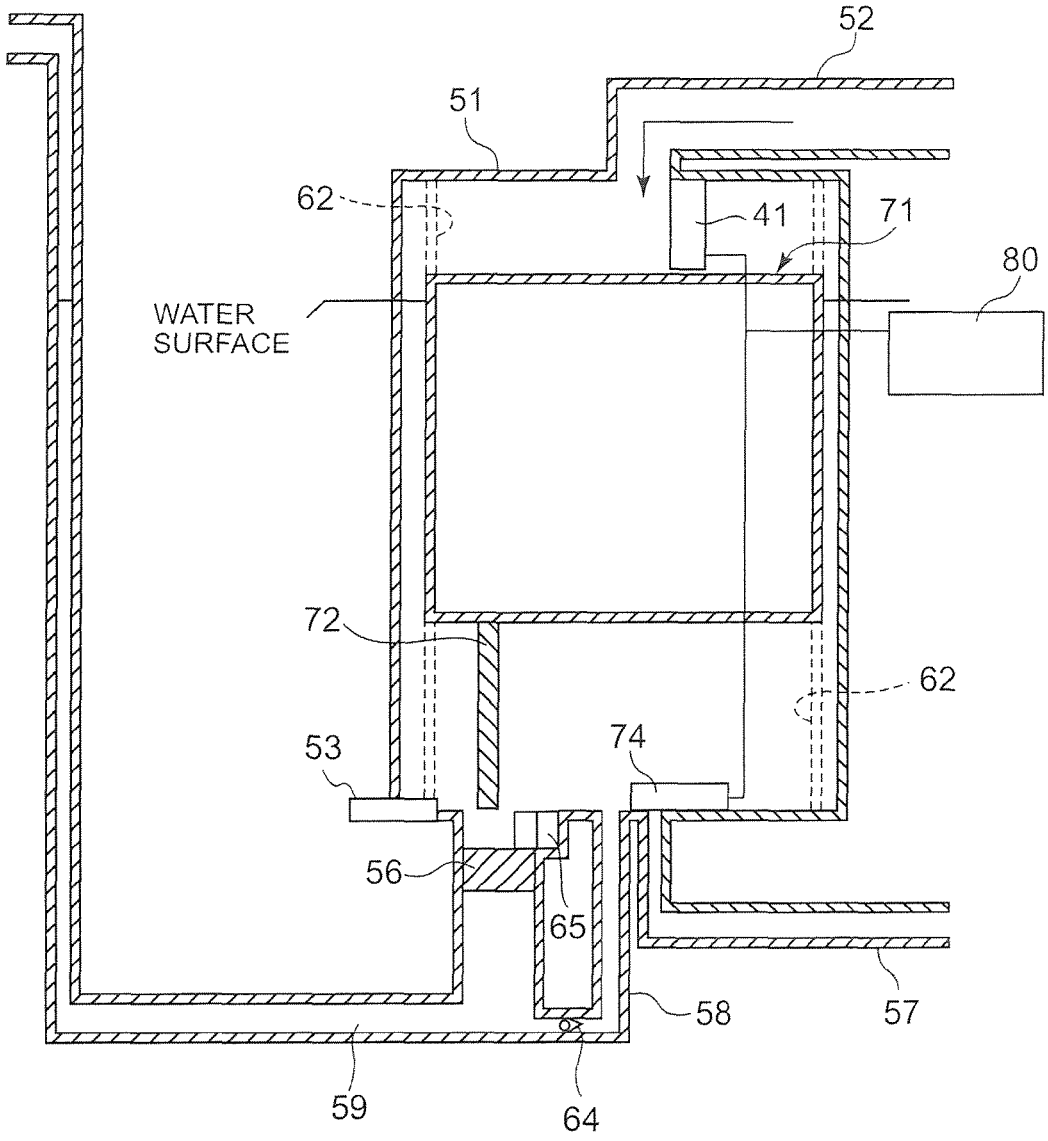
FIG. 8 is a schematic diagram illustrating the side view of the hydraulic pump of Embodiment 3 before one cycle of operation.

As shown in FIG. 8, during the operation, the feeding open/close valve of waterway 52 first opens to feed water into pump outer wall body 51. Feeding water into pump outer wall body 51 allows moving pressure applying member 71 to surface.

Figure 9:
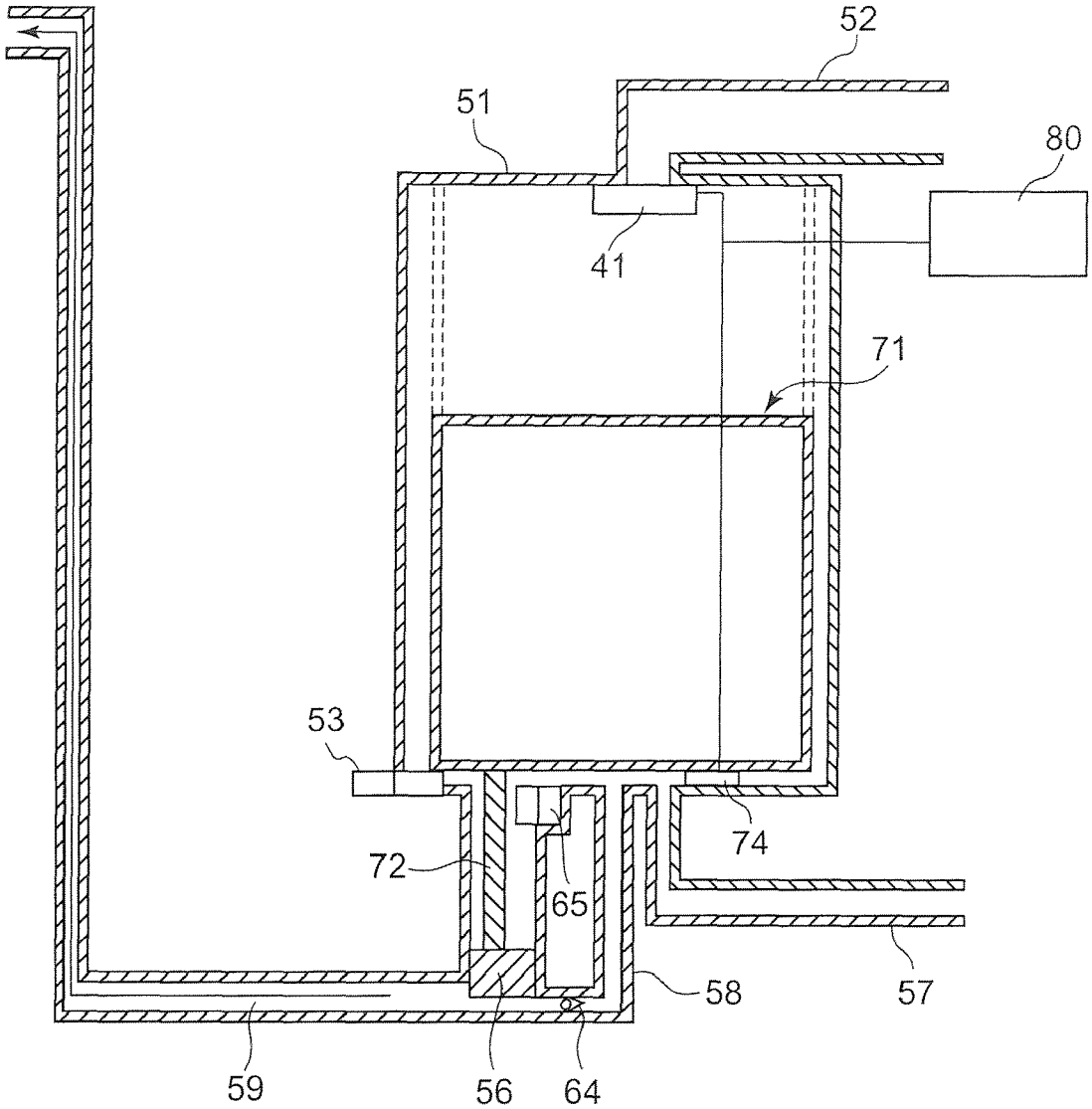
FIG. 9 is a schematic diagram illustrating the side view of the hydraulic pump of Embodiment 3 after one cycle of operation.

As enough water is fed to pump outer wall body 51, as shown in FIG. 9, the discharge open/close valve of discharge pipe 57 opens to discharge water in pump outer wall body 51, allowing moving pressure applying member 71 to move downward as water is discharged.

The downward movement of moving pressure applying member 71 works in the similar manner as that of Embodiment 2 so it is not described in detail here.

Moreover, the discharge open/close valve of discharge pipe 57 may be opened by also opening discharge door 57B to increase discharge efficiency.

As one pumping ends by carrying out the above operation, the water feeding open/close valve of waterway 52 is opened again to feed water into pump outer wall body 51 and to move moving pressure applying member 71 upward.

On the other hand, water may be discharged by the use of one or both of discharge pipe 57 and discharge door 57B. Improving discharging of water under the base of moving pressure applying member 71 is also desirable in view of increasing pumping efficiency.

INDUSTRIAL APPLICABILITY

The present invention can be applied to the field of a pump for pumping water which achieves a significant cost saving without demanding a large consumption of electric power or firepower.

REFERENCE SYMBOLS

1, 2, 3 hydraulic pump
11, 51 pump outer wall body
12, 13, 53, 65 stopper
21 lower reservoir
22 moving pressing member
23, 52 waterway
24, 59 pumping pipe
25, 61, 64 check valve
31, 57 discharge pipe
41 open/close valve
42 protruding section
43 side reservoir area

55 pumping water reservoir
57B discharge door
58 feeding pipe
62 guide
63 circulation space
71 moving pressure applying member
72 pressing member
73 feeding open/close valve
74 discharge open/close valve While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. Thus, the present invention should not be limited by any of the above-described exemplary embodiments, but should be defined only in accordance with the following claims and their equivalents.

The invention claimed is:

1. A hydraulic pump comprising:
a pump outer wall body having a wall body;
a waterway through which water is fed into the pump outer wall body;
a moving pressing member;
wherein the moving pressing member comprises
an open/close valve to supply the water into an inner space of the moving pressing member,
a discharge open/close valve to discharge the water of the inner space, and
a water passage valve to feed the water from the waterway to a lower reservoir, which opens as the moving pressing member moves upward, and closes as the moving pressing member reaches to a surface of the water which is fed into the pump outer wall body;
the moving pressing member being longitudinally movably housed within the pump outer wall body to compress the lower reservoir and move downward as the water is fed from the waterway, and to move upward due to buoyancy as the water is discharged from the discharge open/close valve after being fed from the open/close valve;
a pumping pipe which is connected to a bottom of a base side of the pump outer wall body to transport the water by the downward movement of the moving pressing member; and
a discharge pipe, which is connected to the bottom of the base side of the pump outer wall body to discharge the water after the water is fed to the moving pressing member which is in the bottom of the pump moving pressing member.

2. The hydraulic pump as set forth in claim 1, further comprising a side reservoir for the water passage valve occupying at least some space between the pump outer wall body and the moving pressing member.

3. The hydraulic pump as set forth in claim 1, wherein the pump outer wall body comprises a stopper to limit the range in which the moving pressing member can move longitudinally.

4. The hydraulic pump as set forth in claim 1, wherein the pumping pipe comprises a check valve.

5. The hydraulic pump as set forth in claim 1, further comprising control means to control opening and closing of the water passage valve.

6. A hydraulic pump, comprising:
a pump outer wall body having a wall body;
a waterway through which water is fed to the pump outer wall body;
a water pump reservoir that is provided at a bottom of a base side of the pump outer wall body to store the water;
a water pumping member having buoyancy which is longitudinally movably housed within the water pump reservoir;
a moving pressure applying member;
wherein the moving pressure applying member comprises
an open/close valve to supply the water into an inner space of the moving pressure applying member which closes as the moving pressure applying member moves upward, and opens when the moving pressure applying member is at a given upper position in the hydraulic pump to supply the water fed from the waterway into the inner space, and,
a discharge open/close valve to discharge the water of the inner space, and
a pressing member longitudinally movably housed within the pump outer wall body to press the water pumping member in the water pump reservoir area,
wherein the pressing member moves downward together with the moving pressure applying member as the water is fed from the open/close valve, and moves upward with the moving pressure applying member due to buoyancy after the water is discharged from the discharge open/close valve;
a pumping pipe which is connected to the bottom of a base side of the pump outer wall body to transport the water in the water pump reservoir being pushed out as the water pumping member moves downward due to the movement of the pressing member;
a discharge pipe which is connected to the bottom of the base side of the pump outer wall body to discharge the water after the water is fed to the moving pressure applying member which is provided at a bottom of the hydraulic pump; and
a feeding pipe to feed water to the water pump reservoir as the moving pressure applying member moves upward after the discharge of the water.

7. The hydraulic pump as set forth in claim 6, further comprising:
a guide member to guide the moving pressure applying member for the longitudinal movement; and
a circulation space for the water which is provided between the pump outer wall body and the guide member to feed the water to the water pump reservoir area.

8. The hydraulic pump as set forth in claim 6, wherein the pumping pipe and the feeding pipe comprise a check valve.

9. The hydraulic pump as set forth in claim 6, further comprising control means to control opening and closing of the open/close valve and the discharge open/close valve.

10. The hydraulic pump as set forth in claim 2, wherein the pump outer wall body comprises a stopper to limit the range in which the moving pressing member can move longitudinally.

* * * * *